United States Patent [19]

Gentry

[11] Patent Number: 4,630,426

[45] Date of Patent: Dec. 23, 1986

[54] FOOD UNIT MAKING AND PACKAGING APPARATUS AND METHOD

[76] Inventor: James C. Gentry, 21461 Encina Rd., Topanga, Calif. 90290

[21] Appl. No.: 735,047

[22] Filed: May 17, 1985

[51] Int. Cl.[4] ..... B65B 9/02

[52] U.S. Cl. ..... 53/428; 53/435; 53/450; 53/453; 53/122; 53/516; 53/517; 53/546; 53/555; 53/559

[58] Field of Search ..... 53/122, 428, 435, 436, 53/450, 453, 514, 516, 517, 546, 553, 555, 559

[56] References Cited

U.S. PATENT DOCUMENTS

| | | | |
|---|---|---|---|
| 1,654,647 | 1/1928 | Heist | 53/450 X |
| 2,657,423 | 11/1953 | Elsaesser | 53/122 X |
| 3,022,616 | 2/1962 | Eiden et al. | 53/122 X |
| 3,481,283 | 12/1969 | Vogt | 53/122 |
| 3,498,019 | 3/1970 | Rait | 53/450 |
| 3,813,848 | 6/1974 | Romagnoli | 53/546 |
| 4,034,536 | 7/1977 | Mahaffy et al. | 53/450 X |
| 4,437,294 | 3/1984 | Romagnoli | 53/122 X |

*Primary Examiner*—E. R. Kazenabe
*Assistant Examiner*—Michael D. Folkerts
*Attorney, Agent, or Firm*—Allan M. Shapiro

[57] ABSTRACT

A conveyor belt of medium-soft thick material is advanced, and a film of polymer material is laid thereon to advance therewith. A moldable material, usually a food material, is extruded onto the advancing base film. A portion-forming wheel having portion cavities around the periphery thereof is positioned with its portion cavities facing the conveyor belt. A cover film is fed onto the portion-forming wheel and is preferably drawn into the portion cavities. As the conveyor belt advances, the portion cavities cut the extrusion of moldable material into individual portions which are enclosed by the two films as the conveyor belt advances. The portion cavities have portion-cutting walls therebetween, and a ramped area around the cavity squeezes all of the moldable material into the portion cavities.

10 Claims, 8 Drawing Figures

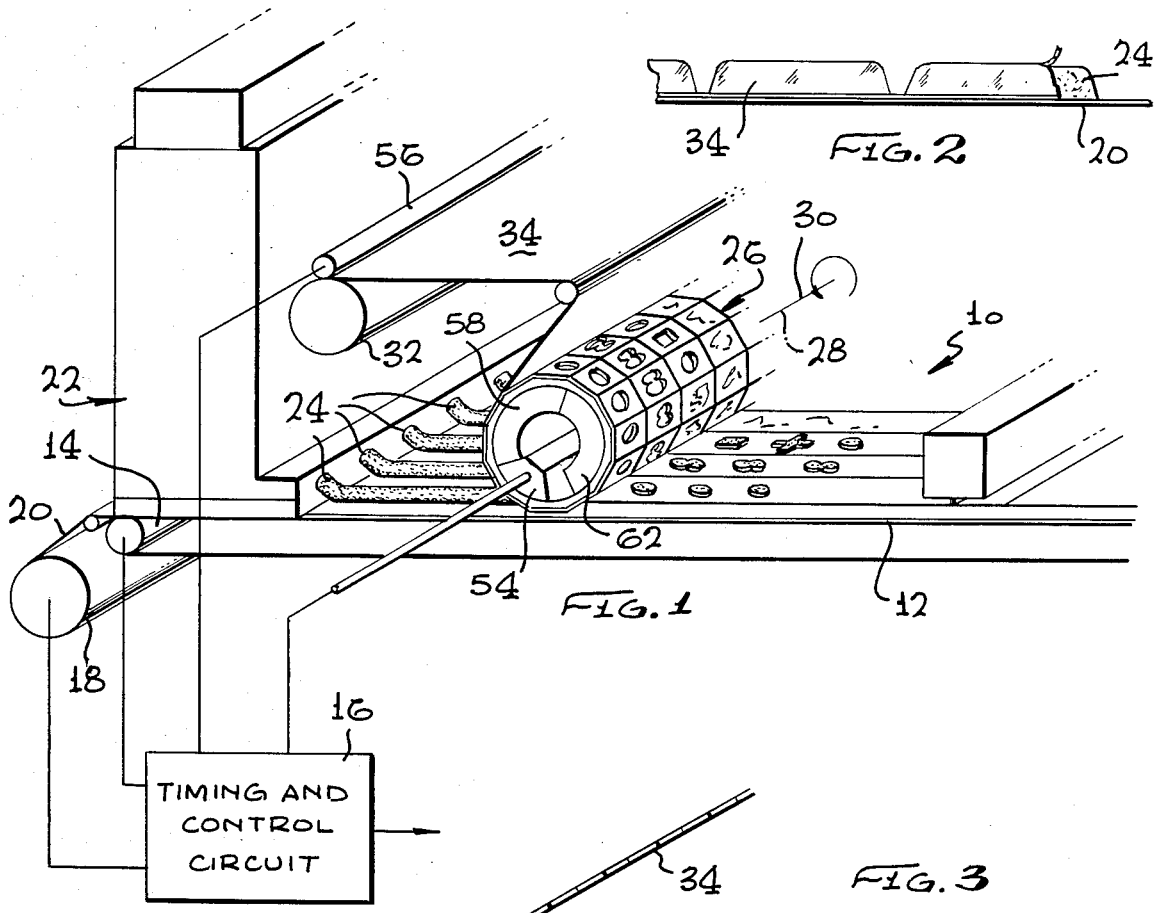
FIG. 1
FIG. 2
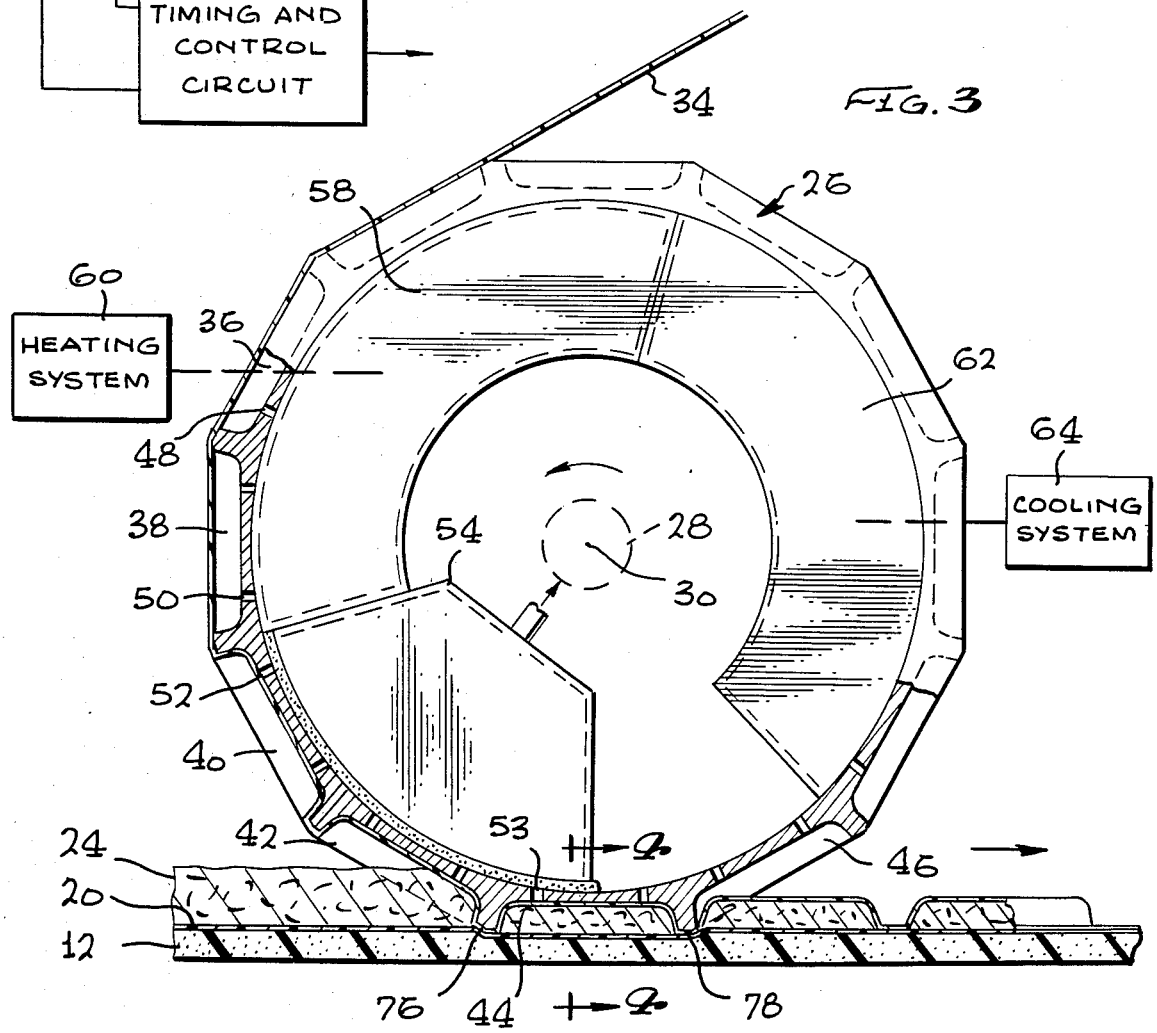
FIG. 3

FOOD UNIT MAKING AND PACKAGING APPARATUS AND METHOD

BACKGROUND OF THE INVENTION

This invention is directed to an apparatus which separates moldable material into individual units which are each enclosed between film layers and the method by which food and other similar moldable materials are separated into individual units which are individually wrapped.

Many processes require the separation of a continuous stream of material, such as extruded material, into individual units. In some cases, the material is chopped as it leaves the extruder. The chopping rate must be closely coordinated with the extrusion rate to obtain units of fairly the same size. All such units can be chopped onto a conveyor belt, and the units must be individually handled for packaging. When the material is food, the conveyor belt must be continuously cleaned and the packaging equipment which directly handles the units must be regularly cleaned.

In modern food handling systems, and particularly in franchise retailers of various food products, a central kitchen prepares the basic food units which are thereupon frozen for storage and shipment to the store which cooks the unit and delivers it freshly cooked to the customer. This method of freshly cooked food items to the customer is found in the retailing of cookies, through fresh-baked cookie outlet stores. The same kind of handling occurs in other kinds of food products, such as hamburgers. However, using existing equipment and processes, the apparatus which separates the moldable food material into units is slow and needs to be regularly and carefully cleaned. This results in high costs of preparing the food unit for shipping and subsequent cooking. As a consequence, there is need for an equipment and method by which unitizing costs can be minimized to increase the economic strength of the industry.

SUMMARY OF THE INVENTION

In order to aid in the understanding of this invention, it can be stated in essentially summary form that it is directed to a food unit making and packaging apparatus and method which includes an advancing conveyor belt onto which a base packaging film is deposited. Moldable material is extruded onto the base film and advances therewith. A facing portion-forming wheel has portion cavities around the periphery thereof. A cover film is positioned on the portion-forming wheel and is preferably arranged so that it enters the portion cavities. The portion cavities separate the extruded material into individual portions and have ramped areas to press those portions into the desired portion unit shape. The two layers of film meet to separate each portion unit from adjacent such units and the outside.

It is, thus, an object and advantage of this invention to provide a simple and inexpensive packaging apparatus which employs inexpensive film packaging material to define separate units which are shaped as desired, with the portion units being formed at high speed without waste or loss of material.

It is another purpose and advantage of this invention to provide a packaging apparatus and method wherein moldable material such as cookie dough or raw hamburger can be extruded and formed into portion units of carefully controlled size with the portions being shaped by the portion cavity to the desired shape, with the size of the portion being determined by the rate of extrusion of the food material with respect to the speed at which the spaced portion cavities are advanced.

It is a further purpose and advantage of this invention to provide a food unit making and packaging apparatus and method wherein the food material leaving the food material extruder touches only packaging film so that the packaging apparatus remains clean of food material.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 1 is a perspective side view of the food unit making and packaging apparatus of this invention, with parts broken away.

FIG. 2 is a side-elevational view of a series of food units made by the packaging apparatus and method of this invention, with part of the cover film broken away.

FIG. 3 is a side-elevational view of the portion-forming wheel and the adjacent conveyor belt, showing how food units are separated and packaged.

DESCRIPTION OF THE PREFERRED EMBODIMENT

Figure 4:
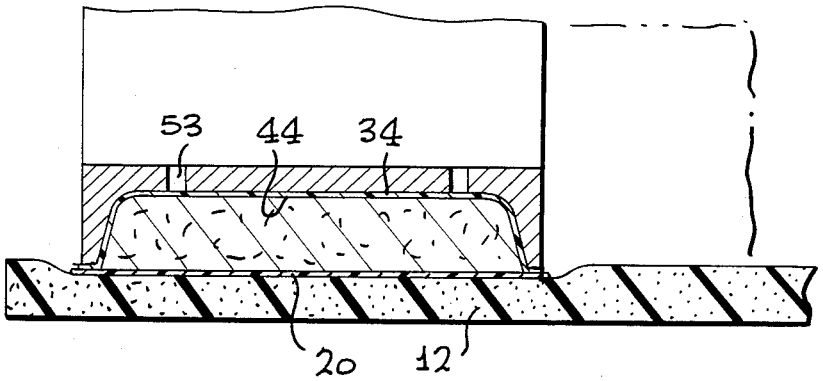
FIG. 4 is an enlarged section taken generally along the line 4—4 of FIG. 3, with parts broken away.

The food unit making and packaging apparatus of this invention is generally indicated at 10 in FIG. 1. The apparatus comprises a conveyor belt 12 which is continuous and extends at least around two belt rollers. Belt roller 14 is shown in FIG. 1 and is the roller which is powered to advance the belt, with the top layer going from left to right in FIGS. 1, 3, 4 and 6. The speed of belt advance is controlled by timing and control circuit 16 which is the main system controller. The conveyor belt 12 is of thick, flexible material and is medium soft. A rubberlike material is preferred. The need for softness will become apparent as the description proceeds, and the degree of softness is related to other structures.

Base film supply roll 18 is positioned adjacent belt roller 14 and supplies base film 20 of packaging material. As is seen in FIG. 1, the base film unwinds from its supply roll to lie on top of the conveyor belt to cover at least that portion of the conveyor belt onto which food material will be deposited. Common film materials are satisfactory, and any film which is flexible and is fairly impervious to air and water is suitable. Pliofilm, polyethylene and many similar films are suitable for this use.

Extruder 22 is positioned adjacent conveyor belt 12 and is oriented so that it extrudes one or more streams of moldable material onto the base film 22 carried by the conveyor belt 12. The extruder 22 shown in FIG. 1 is of indefinite width, but is shown to extrude a plurality of strands 24 of moldable material onto the base film 20. It is the diameter of the extrusion and the rate of extrusion which determines the rate at which the moldable material is supplied to the base film on the conveyor belt. While the apparatus 10 is useful in making individual units and packaging such individual units of any kind of moldable material, it is particularly useful as an apparatus for making units and packaging food material. Hamburger patty units may be made of ground beef by the method and apparatus of this invention, but the method and apparatus are particularly useful in making units and packaging fully mixed but uncooked cookie dough.

Portion-forming wheel 26 is mounted on shaft 28 to rotate on an axis 30 which is parallel to the top flat face of the main run of conveyor belt 12. A supply roll 32 of cover film 34 is positioned to deliver film to the periphery of the portion-forming wheel. As is seen in FIGS. 1 and 3, the portion-forming wheel has portion cavities therein. In order for the cover film 34 to line the bottom of those cavities, one or more additional means may be taken. Portion cavities 36, 38, 40, 42, 44 and 46 are shown as extending halfway around the portion-forming wheel 26. There is a continuous set of cavities around the periphery, equally spaced. As is seen in FIG. 3, the cover film 34 lies on the outer periphery of the cavities. Each of the portion cavities has one or more vacuum holes in the bottom thereof, with vacuum holes 48, 50 and 52 being shown with respect to cavities 36, 38 and 40. Vacuum hood 54 is provided interiorly of the portion-forming wheel so that, as portion cavities pass thereby, vacuum is drawn on the portion cavities. Such vacuum draws the cover film 34 into the cavities to line the cavities. In order to aid in the supplying of enough cover film to line the cavities without undue stretching, cover film feed roller 56 may be controlled by circuit 16 to advance the film at such a rate as to supply it at a surface speed equivalent to the surface speed of the portion-forming wheel as it is seen through the center of the portion cavities. In this way, the cover film would not need to stretch, but it would wrinkle around the edges of the portion cavities as it is drawn therein.

When cover film 34 is advanced at that rate, there is probably no need for other means for aiding in permitting the film to reach the bottom of the cavities. However, if the cover film is stiff and thermoplastic or if the film 34 is fed at a slightly slower rate than the surface speed through the bottom of the portion cavities, then heating may be helpful to aid in the conformation of the film. Heater 58 is positioned inside of the portion-forming wheel, from a position adjacent where the cover film contacts the wheel to vacuum hood 54. Heating system controller 60 controls the rate of heating. When such a heating system is used, cooling system 62 with its cooling system controller 64 may be necessary to keep the portion-forming wheel at a reasonable temperature. As another means by which heating can be accomplished, steam could be injected through the vacuum holes into the cavities 36 and 38 after they are covered by the cover film 34 and before those cavities reach the vacuum hood. In this way, cover film 34 conforms to the portion cavities in the portion-forming wheel.

Figure 5:
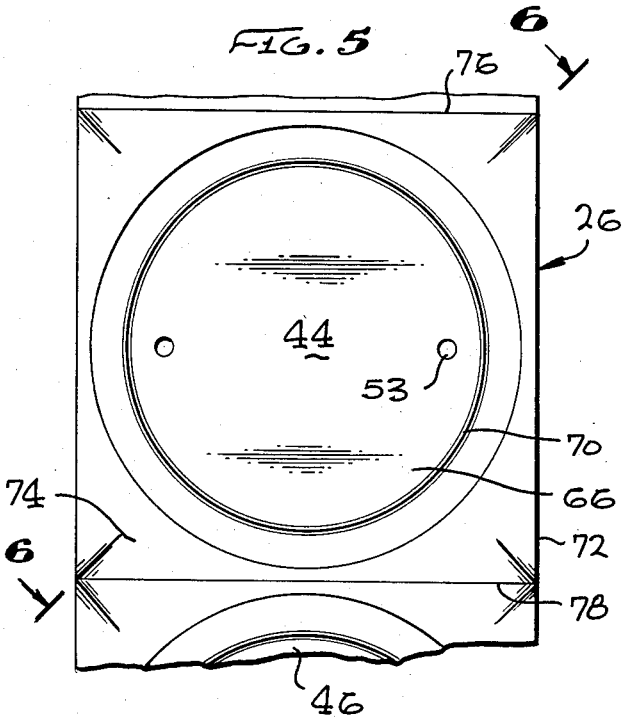
FIG. 5 is a view looking up into one of the portion cavities on the portion-forming wheel, with parts of the wheel broken away.
Figure 6:
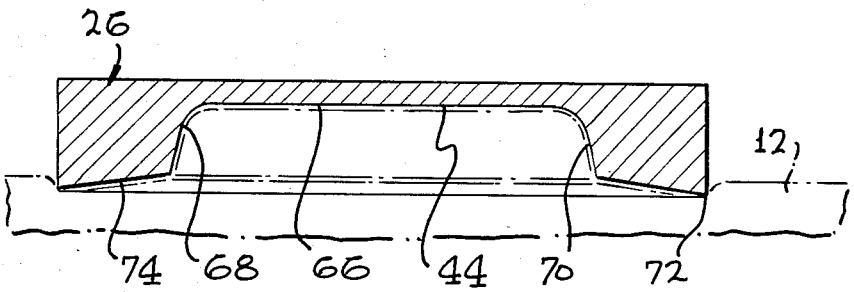
FIG. 6 is a section taken generally along the line 6—6 of FIG. 5.

FIGS. 4, 5 and 6 show the downwardly facing portion cavity 44, while FIGS. 3, 4 and 5 show its vacuum holes 53. FIGS. 3 and 4 show the cover film 34 pulled up into the cavity to line the cavity. The cavity represents the desired maximum volume of the food unit to be made and represents the desired shape of the food unit. In the case of the cavities on portion-forming wheel 26, the cavities are flat, circular spaces with rounded bottom edges and conical walls. Such a shape would be suitable for meat patties or cookies. The periphery of the portion-forming wheel 26 carries a plurality of molds with the portion-forming cavities therein. As is illustrated in the embodiment of FIGS. 1, 4, 5 and 6, the peripheral structure is a unitary structure formed of this plurality of molds, lying adjacent each other, and lying around the periphery of the wheel. The cavities in a wheel may be identical or may be different. Considering the particular cavity 44, as illustrated in FIGS. 5 and 6, it has a substantially flat bottom 66 which joins to the frusto-conical walls 68 with a smoothly radiused fillet 70. The outer edge 72 is rectangular or square and forms a plane which can indent into the substantially planar surface of conveyor belt 12. The area between the outer edge 72 and conical wall 68 is a ramped press area 74 which is angled from edge 72 inward at a slight angle somewhat toward the cavity bottom 66. The angle of the ramped press area 74 with respect to the plane defined by the edge 72 is small, but it is sufficient to squeeze the moldable material into the cavity away from the press area. It is critical that the positioning of axis 30 in distance from the plane or belt 12, together with the softness of the rubber and the angle of the ramped press area 74 is such that the intersection of the ramped press area 74 and the wall 68 is not above the plane of the top of conveyor belt 12 when it is in its unstressed condition. This means that the entire ramped press area resiliently presses down into engagement with the top surface of the conveyor belt 12. The first contact is near the outer edge 72, and, with compression of the belt to the maximum when the cavity is directly facing the belt, the entire ramped press area is in contact with the belt. This squeezes all of the moldable material out of the ramped press area into the portion cavity. The cover film is pressed directly into contact with the base film throughout the ramped press area to obtain a complete seal for the moldable material within the portion cavity. As is seen in FIG. 3, the portion cavities are successively arranged around the periphery and successively engage portions of the extruded moldable material. The edges first cut the extruded material into length, defined by the front and rear edges 78 and 76 of the mold which contains the cavity 44. As is seen in FIGS. 3 and 5, the cavities lie close to each other along their center line so that cutting is achieved by the front and rear edges to cut the moldable material into units. As described, the units are then molded into the shape of the cavity.

The maximum volume of the food unit is the complete fill of the portion cavity in question. If a lesser quantity is desired and slightly less than full fill is desirable, the extruder can be run a little slower or with a smaller cross-section, or the packaging apparatus, including the conveyor belt 12 and portion-forming wheel 26, can be run faster. Such can be accomplished by control of circuit 16.

In the portion-forming wheel structure in FIG. 3, the wheel periphery with the plurality of portion cavities is a one-piece structure. As shown in FIG. 1, a plurality of portion structures can be arranged axially along the length of the portion-forming wheel 26, with a strand of moldable material extruded for each set of portion cavities. As is seen in FIG. 1, each circumferential set of portion cavities may be the same, with the same or different cavity shapes in different circumferential sets. Furthermore, in the third circumferential set of portion cavities illustrated in FIG. 1, the cavities are of different shapes around the wheel. Suitable shapes are illustrated in FIGS. 5 and 8, and other shapes are possible.

Figure 7:
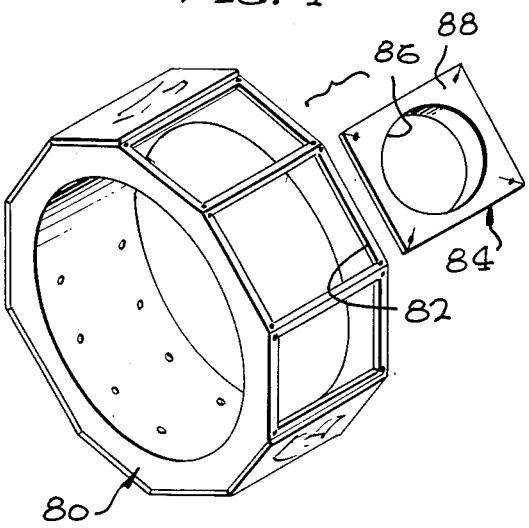
FIG. 7 is an isometric view of the portion-forming wheel showing that the molds carrying portion-forming cavities may be removable.

FIG. 7 illustrates a portion-forming wheel 80 in which the molds containing the portion-forming cavities are removable and interchangeable. The portion-forming wheel 80 is a structure which is mounted for rotation, facing the conveyor belt 12. A series of pockets around the periphery of portion-forming wheel 80 is configured to receive molds. Pocket 82 is configured to receive mold 84 which contains portion cavity 86. The ramped press area 88 meets the same characteristics as the ramped press area 74 described with respect to FIGS. 5 and 6. The structure of FIG. 7 is desirable because the molds may be changed to change the mold size and shape to provide more flexibility to the food unit making and packaging apparatus.

Figure 8:
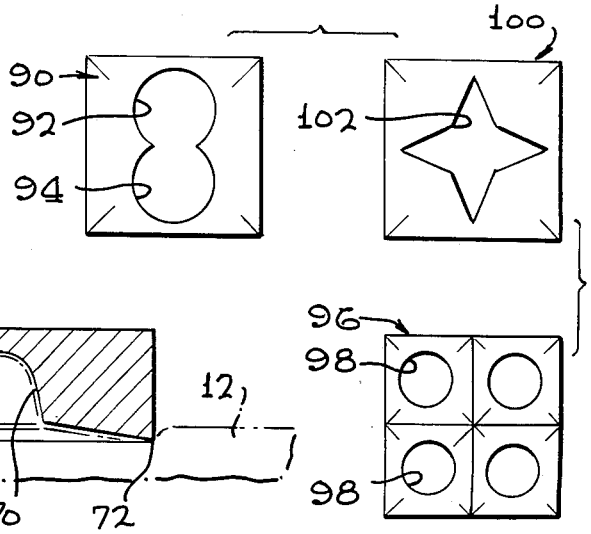
FIG. 8 shows interchangeable molds, each having a different size and shape of portion-forming cavity to illustrate that different shapes and sizes of food units may be formed.

FIG. 8 illustrates several suggested portion cavity sizes and shapes. Mold 90 has a pair of intersecting substantially cylindrical portion-forming cavities 92 and 94. Such cavities are suitable for use in making smaller cookies, where a pair of cookies is handled together in the making, packaging, freezing, storage, transport and baking steps, and, after baking, they can be broken apart to provide separate cookies. Between the margins of the portion cavity and the margins of the mold, the mold 90 is provided with the ramped press area. Each portion cavity has a ramped press area therearound so that all material is squeezed into the portion cavities. Mold 96 has four portion cavities 98 therein. Each is surrounded by a ramped press area which extends from the cavities to the mold perimeter. Mold 100 has a portion cavity 102 in star-shaped configuration. Again, the ramped press area extends from the edges of the portion cavity to the edges of the mold. By providing interchangeable molds in the portion-forming wheel, sizes and shapes can be selected as required.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A food unit making and packaging apparatus comprising:

a resilient conveyor belt, said conveyor belt being made of material which is sufficiently soft so that it is indentable, means for continuously advancing said conveyor belt;

means for supplying a continuous film onto said conveyor belt as said conveyor belt advances moldable material being placed in a continuous strand onto said continuous film on said conveyor belt;

a portion-forming wheel having a plurality of portion cavities around the periphery thereof, each of said portion cavities in said portion-forming wheel being surrounded by mold edges and the periphery of said wheel between said edges and said portions cavities being sloped toward said portion cavities to form ramped press areas so that as said edges and said ramped press areas at the same time engage said conveyor belt and extend below a plane defined by an upper surface of said conveyor belt and indent said conveyor belt, the moldable material is squeezed into said portion cavity;

means for mounting said portion-forming wheel so that its cavities successively face and said mold edges and ramped press areas indent said conveyor belt as said conveyor belt advances;

means for supplying a cover film to said portion-forming wheel so that as said conveyor belt advances and said portion-forming wheel rotates, said portion-forming wheel separates and presses the continuous strand into portions and the portions are packaged between films in said portion cavities.

2. The food unit making and packaging apparatus of claim 1 wherein said portion-forming wheel has a plurality of portion cavities extending continuously around the periphery of said wheel.

3. The food unit making and packaging apparatus of claim 1 wherein said portion-forming wheel has edges around each portion cavity wherein said edges lie substantially in a plane so that when said plane of said edges lies parallel to said plane of said conveyor belt, said portion-forming cavity is fully enclosed.

4. The food unit making and packaging apparatus of claim 1 wherein said portion cavities are each formed in a mold, and said molds are removable from said portion-forming wheel and replaceable with molds of different size and shape.

5. The food unit making and packaging apparatus of claim 1 wherein each of said portion cavities has an opening therein and there is means for drawing vacuum within at least one of said portion-forming cavities so that said cover film is drawn into said portion-forming cavities before moldable material enters said cavities for forming by said cavities.

6. A food unit making and packaging apparatus comprising:

a resilient conveyor belt of material which is sufficiently thick and soft that it can be indented, means for supporting said conveyor belt so that its upper surface lies substantially in a plane;

means for advancing said conveyor belt;

means for laying a base packaging film on said conveyor belt so that said film advances with said conveyor belt;

a portion-forming wheel positioned adjacent said conveyor belt, said portion-forming wheel being rotatable on an axis substantially parallel to the plane of said conveyor belt, a plurality of portion cavities around the periphery of said portion-forming wheel, each of said portion cavities being formed in a mold, each of said molds having an edge with the edges of successive molds around the periphery of said portion-forming wheel lying together, the faces of each mold within said edges being sloped towards said cavity to form a ramped press area, said portion-forming wheel being positioned with respect to said conveyor belt so that said edges and said ramped press areas successively indent into said conveyor belt and extend below said plane of the upper surface of said conveyor belt as said portion-forming wheel and said conveyor belt advance so that material is squeezed by said ramped press area away from said edges towards said portion cavity; and means for supplying a cover film to said portion-forming wheel so that as moldable material is laid on said packaging film on said conveyor belt, said portion cavities successively mold the moldable material into units and package the material between films.

7. The food unit making and packaging apparatus of claim 6 wherein said edges around a particular portion cavity lie in a plane and said portion-forming wheel is positioned so that as said plane of said edges lies parallel to said plane of said conveyor belt, said edges indent said conveyor belt.

8. The food unit making and packaging apparatus of claim 6 wherein said molds are detachably removable from said portion-forming wheel.

9. A food unit making and packaging method comprising the steps of:

advancing an indentable conveyor belt;

laying a base layer of packaging film upon the conveyor belt;

laying a continuous strand of moldable material on the conveyor belt as it advances;

positioning a portion-forming wheel having edges around portion cavities therein with ramped press areas within the edges and around the portion-forming cavities, with the portion-forming cavities around the periphery of the portion-forming wheel and sufficiently close to the conveyor belt to rotate and indent the conveyor belt as the conveyor belt advances;

laying a layer of cover packaging film on the portion-forming wheel to cover the portion cavities therein; and forming units of moldable material by cutting the strand of moldable material by the portion-forming wheel between the cavities and forcing the moldable material into the cavities by the edges and ramped press areas indenting the conveyor belt to form separate portion cavities so that the moldable material is cut into units, shaped by the shape of the portion cavities, and packaged between the films.

10. The food unit making and packaging method of claim 9 further including the step of drawing vacuum in the portion cavities covered by the cover film to draw the cover film into the portion cavities.

* * * * *